United States Patent [19]

Yamazaki et al.

[11] 4,292,922

[45] Oct. 6, 1981

[54] DEVELOPING DEVICE FOR AN ELECTROPHOTOGRAPHIC COPYING MACHINE

[75] Inventors: Yoshio Yamazaki; Nin-ichi Kamogawa; Yasuyuki Iwai, all of Hachioji, Japan

[73] Assignee: Konishiroku Photo Industry Co., Ltd., Tokyo, Japan

[21] Appl. No.: 122,769

[22] Filed: Feb. 19, 1980

[30] Foreign Application Priority Data

Feb. 24, 1979 [JP] Japan ..... 54-21101

[51] Int. Cl.[3] ..... G03G 15/09

[52] U.S. Cl. ..... 118/657; 118/658

[58] Field of Search ..... 118/657, 658

[56] References Cited

U.S. PATENT DOCUMENTS 3,552,355 5/1971 Flint ..... 118/657 X

*Primary Examiner*—Bernard D. Pianalto

*Attorney, Agent, or Firm*—Bierman & Bierman

[57] ABSTRACT

A magnetic brush type developing device for a single component developer having an axially elongated sleeve and a plurality of magnets disposed in the sleeve for relative rotation therebetween includes a regulating plate extending axially along and substantially adjacent the sleeve surface for regulating the height of developer adhering thereto, and a pair of partition plates arranged substantially perpendicular to the sleeve axis at axially opposite ends thereof and predeterminately adjacent circumferentially-disposed surface portions of the sleeve for preventing an axial flow of developer along the sleeve outwardly beyond the partition plates.

10 Claims, 7 Drawing Figures

DEVELOPING DEVICE FOR AN ELECTROPHOTOGRAPHIC COPYING MACHINE

BACKGROUND OF THE INVENTION

This invention relates to a magnetic brush type developing device for use in an electrophotographic copying machine, and more particularly a magnetic brush type developing device used with a one component developer as is per se well known.

In an electrophotographic copying machine using a magnetic brush developing device, copied matter is obtained by reflecting light from an original to be copied, projecting the light onto a uniformly charged photosensitive member to form thereon an electrostatic latent image corresponding to the original, developing the latent image by a developer to render it visible, and then fixing the latent image on the member or after it is transferred onto a transferring paper such as plain paper. Developer (not shown) is stored in a developing chamber in which a cylindrical sleeve made of nonmagnetic material is so arranged that is is adjacent to the surface of the photosensitive member and a part of the sleeve is dipped into the developer. Inside of this sleeve, a plurality of magnets are arranged adjacent to the inside surface of the sleeve and with a given spacing, and the sleeve and the magnets are so constituted as to be able to relatively rotate. Accordingly, developer in the developer chamber is transported along the sleeve surface with the rotation of the sleeve or the magnets, and a visible image is formed on a photosensitive member as the developer comes into contact with the surface of the photosensitive member. When the developer is transported from the developer chamber, it is regulated at a certain fixed height on the sleeve by a regulating plate arranged adjacent to the outside surface of the sleeve. In other words, the developer adhered to the sleeve surface is transported to a developing position in the form of brush like tufts. Such a developing device as mentioned above is known as a magnetic brush type developing device.

Most of the presently popular electrophotographic copying machines are using a developer comprising magnetic powder (the so-called carrier) and fine grains of colored resin (the so-called toner) which, being constituted independently, define a type of developer called two-component developer. In conradistinction to two-component developer, a developer comprising toner only—that is, so-called one or single-component developer—has been developed. Because this latter type developer comprises magnetized toner having a magnetic substance in resin and containing colorant as occasion demands, density deviation of the copied image due to gradual toner consumption (as caused when using a two-component developer) is not a problem. As a consequence, copying machines using one-component developer do not require any density detecting device, or special toner replenishing device and carrier changes, and have many advantages as of making the developing device itself compact and so forth. Owing to the above facts, single component developer is being gradually put into practical use.

Two-component developer normally comprises carrier comprising a magnetic substance of about 50–200$\mu$ in diameter of a large grain and fine grain toner of about 5–20$\mu$ in diameter of a grain, and iron powder is used as the magnetic substance for the carrier. The mixing ratio of carrier and toner is approximately 2–10% by weight of toner with respect to the iron powder.

In two-component developer, a carrier of iron powder is adhered onto the sleeve by influence of magnetic force generated by a plurality of magnets fixedly provided within the sleeve, and transported in accordance with the rotation of the sleeve. The toner is transported in a body with the carrier, because the toner is strongly adhered electrostatically around the surface of the carrier of iron powder; thus, it is very seldom that toner is scattered in the course of transportation. And, since the carrier particle is heavy and its diameter is large, it is rare that it runs out through a narrow opening and so forth.

On the other hand, with a single component developer there is no grain of large diameter corresponding to carrier in the two-component developer; moreover, there are quantities of resin components in the particles of developer, and components of magnetic substances comprising at most 20–80% by weight of the developer, which is far less than that of a two-component developer.

Where a single component developer as stated above is used in a magnetic brush type developing device, and the sleeve or the group of magnets is rotated at a reasonable rate of revolution (e.g. 300 rpm), developer is blown up and scattered in a haze and contaminates in and outside of the developer chamber, or the developer penetrates into rotating shaft bearings of the sleeve or the group of magnets and thereby increases the friction of rotation and subsequently presents an obstacle to rotation of the shaft. The adhesion force of single component developer to the sleeve is reasonably weak, because the ratio of the magnetic component contained in the developer is low. Due to the above, adhesion of the developer to a magnetized portion of the developing device cannot be obtained to the same degree as with a two-component developer, despite compensation made by increasing the magnetic force of the group of magnets. Therefore, the thickness of the layer of developer which is formed on the sleeve becomes thin to a degree of 1–1.5 mm and consequently the clearance between a regulating plate for forming brush-like tufts of the developer and the sleeve necessarily becomes reasonably narrow. The developer, transported through the narrow clearance which regulates its height, spreads towards the outside and swells at both ends of the regulating plate, because of its weak adhesion force to the sleeve; this affects the results of subsequent development.

And, as opposed to the case of toner replenishment of two-component developer, a replenishing quantity of single-component developer does not exert a direct influence upon image density. It is a distinct advantage of single-component developer that a user can decide on the addition of a replenishing quantity at his option; but if replenishment is effected to an extent that as a rotating shaft bearing of the sleeve or the group of magnets is immersed into the developer, it is feared that particles will penetrate into a bearing portion and increase the load or friction of rotation and then cause an obstacle to free movement of the bearing.

At present, several electrophotographic copying machines having a magnetic brush type developing device and using a single component developer have been proposed (e.g. Laid Open Patent Exposure Nos. 52-10146 and 52-34742 in Japan), most of which are of the type in which developer is added or supplied in only a necessary quantity from a toner storing portion equipped atop the sleeve and into the developer chamber of the developing device. However no means to solve the problems peculiar to the above mentioned single-component developer have been introduced.

The present invention is directed to solving the peculiar faults mentioned above that arise when using a single component developer (also sometimes called a magnetic toner) for a magnetic brush type developing device. In accordance with the invention, a partition plate is arranged adjacent to the surface of both axially-directed ends of the sleeve of a developing device; preferably, the partition plate is constructed having a thickness of 0.15–1.0 mm and a clearance between it and the sleeve surface is kept to less than 0.35 mm. And, where the partition plate is set in non-contact with the sleeve surface, an auxiliary partition member is arranged to contact with the partition plate, and a clearance between the auxiliary partition member and the sleeve surface is preferably kept to less than 0.35 mm.

The following is a detailed explanation of the present invention referring to the drawings attached hereto.

DETAILED DESCRIPTION OF THE PREFERRED EMBODIMENT

Figure 1:
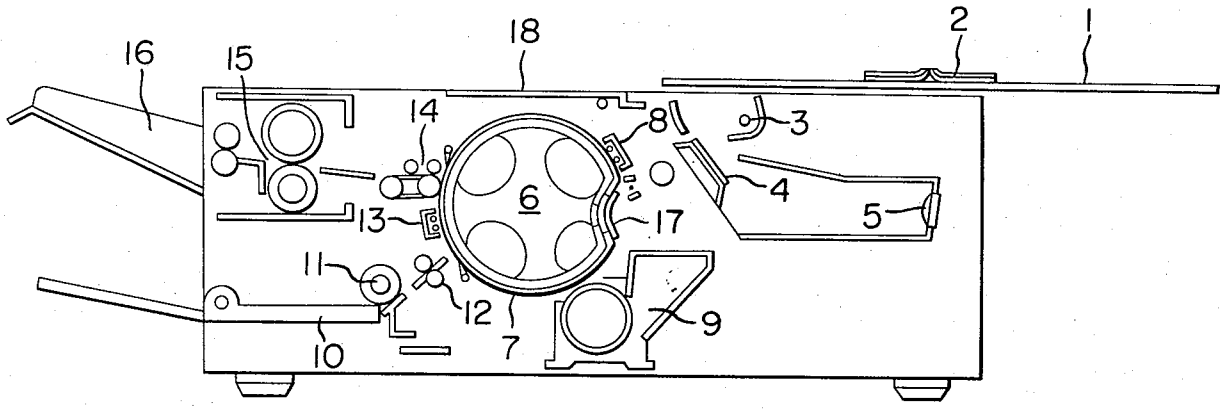
FIG. 1 is an outline diagram that shows the structure of an embodiment of an electrophotographic copying apparatus that uses a magnetic brush type developing device related to this invention.

In FIG. 1, an original 2, which is put onto a movable copy board 1, is projected with a light ray by the lamp 3 as the copy board 1 is moving, and a reflected light ray from the original to be copied is projected through the reflecting mirror 4 and the lens 5 onto a sheet-type photosensitive member 7 which is tightened on the peripheral surface of a rotating drum 6. Since the photosensitive member 7 is electrically charged evenly in advance by a charging electrode 8, and earlier than the time when the reflected light from the original 2 is projected onto it, an electrostatic latent image corresponding to the original is formed. The electrostatic latent image is developed by the developing device 9 being thereby changed to a visible image (a toner image), and is then transferred by the transferring electrode 13 onto transfer paper (not shown) which is supplied from the supplying tray 10 through a supplying roller 11 and a pair of carrying rollers 12 (referred to hereinafter as the carrying roller). Then the transfer paper being held in contact with the photosensitive member 7 by an electrostatic force is separated therefrom with the aid of a separating means (no reference symbol), is transported by the transporting device 14 toward a fixing device 15, and is fixed there and then ejected onto a receiving tray 16 positioned outside of the machine body.

The sheet-type photosensitive member 7 is attached on and around the peripheral surface of the rotating drum 6 through a fitting plate 17 prepared on a part of the drum 6 so as to receive both ends of the member 7. The member 7 is changed manually by an operator, after completion of a given number of copying operations, by opening the top cover 18 of the copying machine which is nearly atop the rotating drum.

Figure 2:
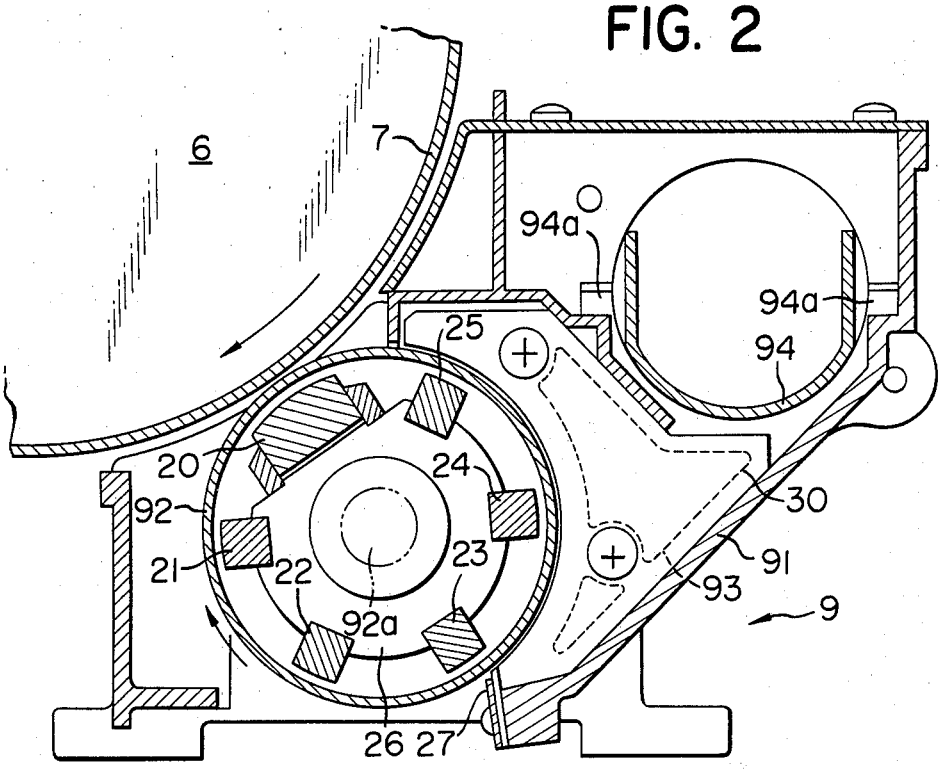
FIG. 2 is an enlarged partial cross sectional view of a magnetic brush type developing device related to this invention.
Figure 3:
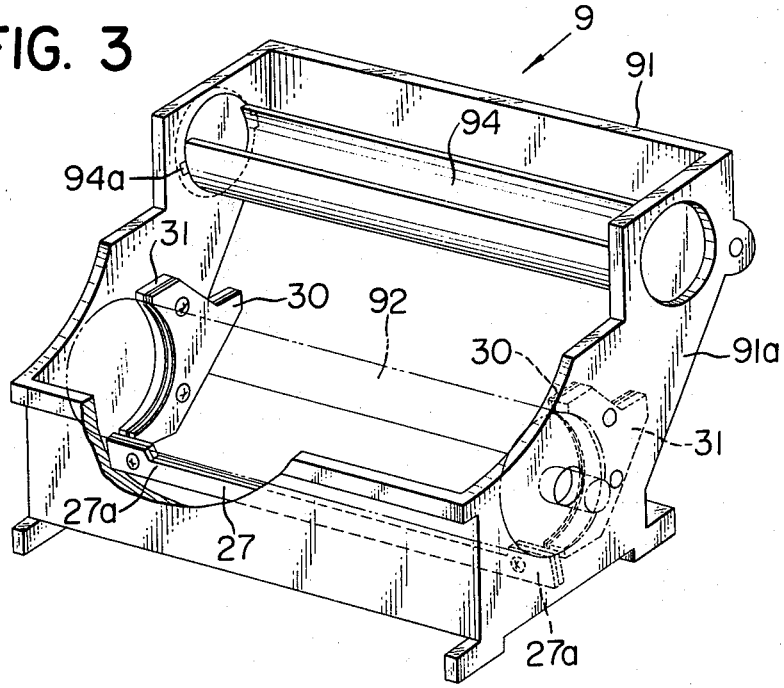
FIG. 3 is a perspective view that shows a main point of this invention.

In FIGS. 2 and 3, the developing device 9 shown in the illustration is a magnetic brush type developing device and is arranged adjacent to the rotating drum 6. Inside of the casing 91 a sleeve 92 made of a non-magnetic and electroconductive material is suspended by the rotating shaft **92*a* and is also set so as to be rotatable at a position adjacent to the photosensitive member 7 of the rotating drum 6 (for convenience of description, the combination of the photosensitive member 7 and the drum 6 is referred to hereinafter as the photosensitive drum 7). Inside the rotating sleeve 92, a main magnet 20 for development and five pieces of the auxiliary magnets 21, 22, 23, 24 and 25 are so arranged on a support 26 as to be adjacent to and opposed to the internal surface of the sleeve 92 and both the magnets and the support are held stationary. The polarities of these magnets are alternatingly arranged at N and S. A space to contain and maintain developer—i.e. the developer chamber 93—is formed inside the casing 91 and against the sleeve 92 on the opposite side of the photosensitive drum 7. A regulating plate 27 for regulating the thickness of the single-component developer adhered to the sleeve is fixed to a portion of the casing 91 by screws underneath the outside of the rotating sleeve 92. As will be appreciated from FIG. 3, the regulating plate 27 is a plate whose length is almost the same as that of the rotating sleeve 92 and is so formed that both its ends are a little wider than the control portions thereof. This wider portion 27*a* is principally at the upper part of the non-magnetic section and is arranged adjacent to the sleeve 92 or to contact with the sleeve 92 by use of an auxiliary material as will be described hereinafter; thus, the regulating plate 27 is capable of protecting from leakage of developer at the regulating section and from swelling at the end section. It should be understood that the developer chamber 93 is formed by a part of the sleeve surface, a part of the casing 91, the regulating plate 27 and a bending portion (no reference symbol) of the casing which is at upper portion of the sleeve. A member having the bending portion described above may be made separately from the casing 91. Atop the developing device 9, a cassette 94 for developer replenishment is loaded from outside. A certain standard quantity of single component developer is stored in an arc-shaped case of the replenishing cassette 94 that is supported with the case 91 through guide rails (no reference symbol) provided on the casing. Accordingly, at least one end of the cassette 94 carries two projections 94*a* which protrude radially outward therefrom. The cassette is thus smoothly inserted along the rails by use of the projection. After loading, the cassette is capable of rotation, since the projections are out of side wall 91*a* of the casing 91. When necessary, replenishment is effected by dropping the developer into the developer chamber 93 by manually giving a 180° rotation to the cassette 94** from outside of the machine.

Figure 4:
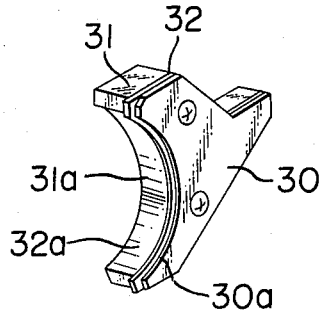
FIG. 4 is an assembly perspective view of a partition plate and its related members.
Figure 5:
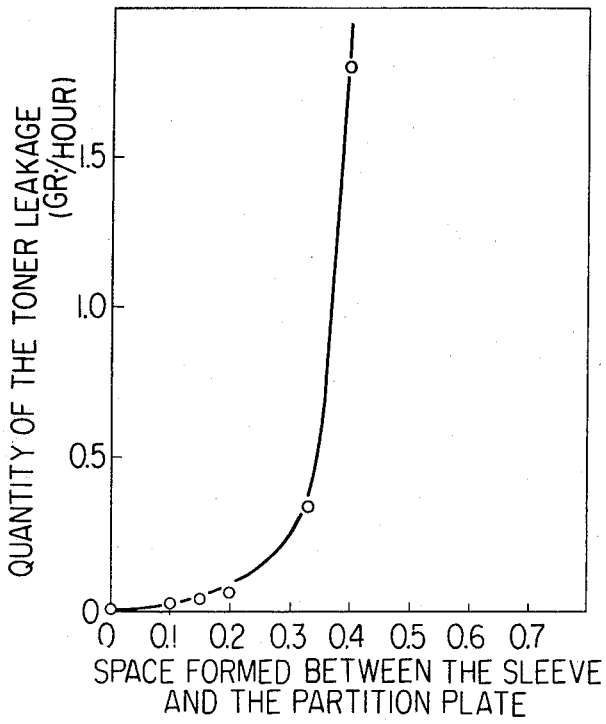
FIG. 5 is a graph that shows a variation of the leakage amount of the developer with respect to the variation of the clearance between the partition plate and the surface of the sleeve.

Now, due to the fact that the diameter of the developer particle is small, the developer stored in the developer chamber 93 is blown up like a haze in the developing chamber 93 by the rotation of the rotating sleeve 92; furthermore, the developer travels about both ends of the rotating sleeve 92 and the particles penetrate into the rotating bearings (not shown), increasing the rotation load of the rotating sleeve 92 and, in its turn, causing a seizure. To protect against the above defects, a partition plate 30 is arranged adjacent to both ends of the rotating sleeve 92 inside the developer chamber 93. Each partition plate 30 is fixed from inside with a partition plate fitting member 31 that is attached with screws from outside to the side plate 91*a* of the housing 91; for convenience, an auxiliary partition member 32 may be interposed between the partition plate 30 and the fitting member 31 (refer to FIG. 4). The partition plate fitting member 31 is made of a non-magnetic metal or other non-magnetic substance such as a synthetic resin, for example, and its curved or circular surface 31*a* is positioned in opposition to the surface of the rotating sleeve 92 with a predetermined clearance in an operative condition. The partition plate 30 is a thin plate of non-magnetic substance (for example, of phosphor bronze) having a preferred thickness of 0.15–1.0 mm for a developer of 5–20$\mu$ in particle diameter, and it is particularly suitable that the thickness of the plate be within the range of 0.2 mm–0.3 mm. The clearance between a circular or curved edge 30*a* and the surface of the rotating sleeve 92 is important for avoiding leakage of developer from both ends of the rotating sleeve in the axial direction, and, as a result of experiment, it was found that less than 0.35 mm of clearance is preferable. FIG. 5 shows the results of measuring the relative amounts of leakage of the developer while changing the clearance between the partition plate 30 and the surface of the rotating sleeve 92 (where the clearance between the partition plate 30 and the end edge of the magnetized section is set within the range of 1–6 mm.), and from the graph of this Figure, it can be understood that when the clearance becomes 0.35 mm or more, the amount of leakage increases radically. Realistically, however, it is difficult to make the clearance between the partition plate 30 and the surface of the rotating sleeve 92 less than 0.35 mm using mass production techniques; furthermore, where the partition plate is made for example of phosphor bronze, the surface of the sleeve will be damaged if the partition plate contacts the sleeve and the accuracy of the clearance between the partition plate 30 and the rotating sleeve 92 is especially important. This problem is solved by interposing the auxiliary partition member 32 between the partition plate 30 and the fitting member 31 and by contacting its circular edge 32*a* with the surface of the rotating sleeve 92. The auxiliary partition member 32 is made of a non-magnetic substance and is a deflective plate which has a stable restorability, and plastic films which do not cause damage to the surface of the sleeve even if contacted therewith—such a polyester, polycarbonate and the like (known under the trade names of Polyimide, Teflon, Myler and so forth)—are preferably used for the members 32. The preferable thickness of the auxiliary member 32 is 0.15 mm–1.0 mm, and more particularly 0.2 mm–0.3 mm. The auxiliary member 32 must be stable and resistant to the heat caused by friction with the rotating sleeve 92 and also to the wear and tear resulting from the circular edge 32*a* of the auxiliary member 32 being always in contact with the surface of the rotating sleeve 92.

Figure 6:
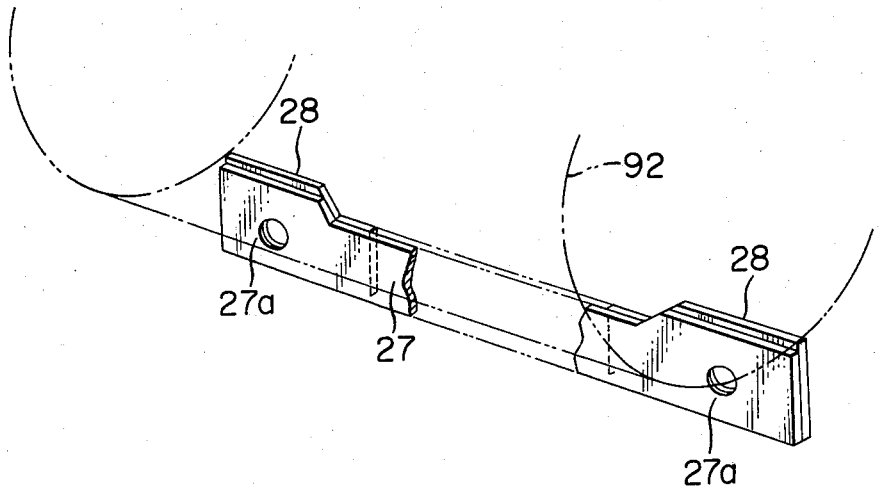
FIG. 6 is a perspective view that shows the structure of the regulating plate related to this invention.

On the other hand, in order to protect against the developer being spread and swollen on the outside of both ends of the regulating plate 27 when the developer height is regulated by the regulating plate 27 and is then transported from the developer chamber 93, the clearance between the top end of the wider section 27*a*—which is arranged at both ends of the regulating plate 27—and the surface of the rotating sleeve 92 is also preferably set at 0.35 mm or less. However, similar to the case of the partition plate 30, the regulating plate is made of a comparatively hard material (such as metal or hard plastic) and the surface of the sleeve will be damaged and its rotating torque excessively increased by contact between the regulating plate 27 and the sleeve surface. Furthermore, mass production problems arise in precisely making a clearance between the top edge of the wider section 27*a* of the regulating plate 27 and the surface of the rotating sleeve 92 of 0.35 mm or less. Problems relating to the preciseness of the clearance have been solved by making an auxiliary regulating plate 28 contact with the wider section 27*a*, as shown in FIG. 6. It is preferable that the auxiliary regulating plate 28 be made of a material of the same nature as that of the auxiliary member 32, and that the thickness of the plate 28 be 0.15 mm–1.0 mm. The auxiliary regulating plate 28 contacts with the surface of the rotating sleeve 92 at the top edge of the plate 28.

Figure 7:
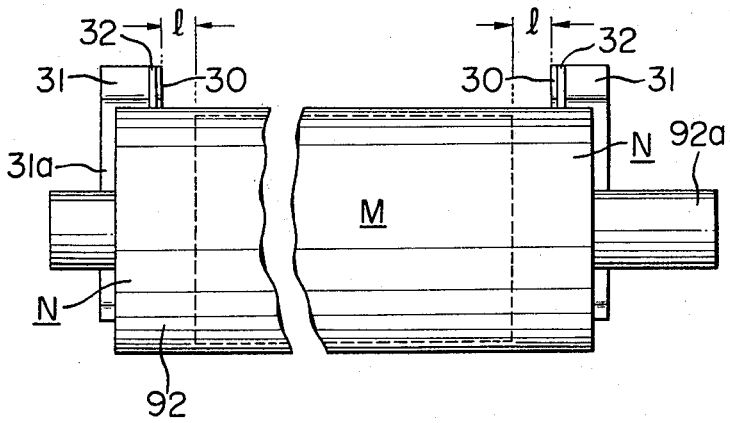
FIG. 7 is an outline diagram that illustrates the arranging position of the partition plate against the sleeve.

Next, the present inventors found that the position where the partition plate 30 is arranged against the rotating sleeve 92 has a great influence upon the quantity of developer leakage. That is, as seen in detail in FIG. 2, inside the rotating sleeve 92 wherein the group of magnets 20–25 is arranged and a magnetized section M (refer to FIG. 7) is formed, it was found that the distance between the end of the magnetized section M and the partition plate 30 located atop the non-magnetized section N has a great influence upon the quantity of developer leakage, and the following results were obtained by experiment.

The quantity of leakage is represented by the weight in grams of developer that leaks in a unit of time:

Distance l (mm): State of leakage of developer (g/hr)
0: Compressed and solidified and formed into lump.
1–6: 0–0.34
>6: 3.2–4.3

From the above results, it can be found that the distance l is preferably in the range of 1–6 mm. In case of l<1 mm—that is, where the partition plate 30 is arranged excessively adjacent to the end of the magnetized section M—a gap between the circular edge 30*a* of the partition plate 30 and the surface of the rotating sleeve 92 is clogged with developer and the developer is compressed and forms into lumps in accordance with increases in the rate of rotation of the rotating sleeve 92. The developer in the shape of a lump is destroyed by some shock or the like and becomes a small lump and enters the developer in the developer chamber 93. When this small lump is carried to the point between the regulating plate 27 and the rotating sleeve, it impedes the height regulating function of the regulating plate and the portion of the small lump alone has a height less than the developer layer or brush-like tufts, causing the phenomenon of a white spot. It goes without saying that this is a fatal defect for copied materials. On the contrary, when l is larger than 6 mm (l>6 mm)—that is, when the partition plate 30 is arranged a considerable distance from the edge of the magnetized section M—the amount of developer that leaks out through the clearance between the partition plate 30 and the surface of the rotating sleeve 92 increases rapidly and the leakage amount is notably large and consequently the utilization rate of the developer falls remarkably. The reason is that a leakage amount of developer of 3–4 grams per hour is the amount of toner contained in 100 grams of two-component developer.

This invention is explained with respect to a rotating sleeve type magnetic brush developing device and it is a matter of course that this invention can be applied to a rotating magnet type magnetic brush developing device in exactly the same manner; likewise, it can also be applied in the same manner to a developing device in which the developer chamber is arranged under the rotating sleeve as seen in a copying device using two-component developer, as well as to a developing device in which the developer chamber is arranged on the side of the rotating sleeve. Furthermore, in the disclosed embodiment, an auxiliary partition member and an auxiliary regulating plate are used but it is not necessary to use such an auxiliary member and an auxiliary regulating plate if the clearances between the surface of the rotating sleeve and the partition plate, and between the sleeve surface and the wider section of the regulating plate, can be kept within 0.35 mm with a good production yield rate.

With this invention, it is possible to prevent particles of developer from entering into the rotating bearings of the sleeve or the group of magnets—resulting in an increase in the rotating load and the seizure of the rotating shaft—by arranging the partition plates near both longitudinal ends of the sleeve in the magnetic brush type developing device that uses a single component developer, and it is also possible to reduce considerably leakage of the developer by keeping the clearance between the partition plate and the surface of the sleeve and the clearance between the ear regulating plate and the surface of the sleeve within 0.35 mm. Moreover, it is possible to reduce leakage of the developer considerably by arranging the partition plates with a clearance in the range of 1–6 mm from the edge of the magnetized section of the sleeve. Furthermore, the swelling of the developer at both ends of the developer layer after the ear regulation can be prevented. In this manner, the problem peculiarly resulting from use of a single component toner in a magnetic brush type developing device has been solved by this invention with simple structure.

What is claimed is:

1. In a magnetic brush type developing device for single component developer and including a casing, an axially elongated sleeve of a non-magnetic material in the casing, and a plurality of magnets disposed in the sleeve for relative rotation therebetween so as to form a layer of developer adhering to the peripheral surface of the sleeve, the improvement comprising;

a regulating plate extending axially along and substantially adjacent the sleeve surface for regulating the height of the layer of developer adhering thereto; and a pair of partition plates, each arranged substantially perpendicular to the sleeve axis and predeterminately adjacent a circumferentially-disposed portion of the sleeve surface proximate one of the axially opposite ends of the sleeve for preventing axial flow of developer along the sleeve beyond said partition plates.

2. In a magnetic brush type developing device according to claim 1, a fitting member for cooperative supporting engagement between each said partition plate and a respective portion of the casing for fixedly positioning each said partition plate inwardly spaced from the casing in a direction axially along the sleeve.

3. In a magnetic brush type developing device according to claim 1, each said partition plate having a thickness in the range of 0.15–1.0 mm, and preferably in the range of 0.2–0.3 mm, and being spaced from the sleeve surface by a clearance of less than 0.35 mm.

4. In a magnetic brush type developing device according to claim 1, an auxiliary partition member on each said partition plate and spaced from the sleeve surface by a clearance of less than 0.35 mm.

5. In a magnetic brush type developing device according to claim 4, each said auxiliary partition member comprising a relatively thin plate formed of a flexibly resilient material.

6. In a magnetic brush type developing device according to claim 5, each said auxiliary partition member being formed of a plastic film material.

7. In a developing device according to claim 1, said regulating plate including a wider portion at each of its axially opposite ends and positioned closer to the sleeve surface than the portion of the regulating plate intermediate said wider end portions, the clearance between the wider portions and the sleeve surface being less than 0.35 mm.

8. In a magnetic brush type developing device according to claim 1 wherein said regulating plate includes a wider portion at each axially opposite end thereof, an auxiliary regulating plate on at least said wider portions of the regulating plate, the clearance between each auxiliary regulating plate and the sleeve surface being less than 0.35 mm.

9. In a magnetic brush type developing device according to claim 8, said auxiliary regulating plate being formed of a relatively thin plate of flexibly resilient material.

10. In a magnetic brush type developing device according to claim 1 wherein the disposal of said plural magnets in the sleeve defines a magnetic section along the sleeve and non-magnetic sections at the axially opposite ends of the sleeve beyond the disposal of the magnets, each said partition plate being arranged predeterminately adjacent one of the non-magnetic end sections of the sleeve at an axial distance of 1–6 mm from the magnetic section of the sleeve.

* * * * *